US012390707B2

(12) United States Patent
Hoss

(10) Patent No.: US 12,390,707 B2
(45) Date of Patent: Aug. 19, 2025

(54) GOLF CLUB GRIP INSTALLATION APPARATUS AND METHOD

(71) Applicant: Steven A Hoss, Udon Thani (TH)

(72) Inventor: Steven A Hoss, Udon Thani (TH)

( * ) Notice: Subject to any disclaimer, the term of this patent is extended or adjusted under 35 U.S.C. 154(b) by 0 days.

(21) Appl. No.: 18/737,400

(22) Filed: Jun. 7, 2024

(65) Prior Publication Data

US 2025/0083009 A1 Mar. 13, 2025

Related U.S. Application Data

(60) Provisional application No. 63/472,868, filed on Jun. 14, 2023.

(51) Int. Cl.
*A63B 57/60* (2015.01)
*A63B 60/42* (2015.01)

(52) U.S. Cl.
CPC ..... *A63B 60/42* (2015.10)

(58) Field of Classification Search
CPC ..... A61M 39/04; A63B 57/60; A63B 60/42; B23P 19/041
See application file for complete search history.

(56) References Cited

U.S. PATENT DOCUMENTS 463,131 A * 11/1891 Allen ..... B67B 7/18 81/3.4
2,160,395 A * 5/1939 Wettlaufer ..... B25B 27/00 29/256
4,043,333 A * 8/1977 Munsch ..... A61M 39/04 604/86
4,783,893 A * 11/1988 Farino ..... A63B 53/02 29/256
4,899,430 A * 2/1990 Farino ..... B25B 13/48 29/256
4,901,418 A * 2/1990 Machado ..... A63B 53/02 29/266
5,137,243 A * 8/1992 Stevens ..... B25B 1/2457 248/912
6,298,546 B1 * 10/2001 Slota ..... A63B 60/42 33/534
6,449,823 B2 * 9/2002 Krapp ..... B25B 13/48 29/244
6,449,860 B1 * 9/2002 Nakai ..... G01B 5/0023 33/508
6,895,680 B2 * 5/2005 Spencer ..... A63B 53/10 33/508
7,043,809 B1 * 5/2006 Latiri ..... A63B 60/42 29/256
2001/0047577 A1 * 12/2001 Krapp ..... B25B 13/48 29/244

(Continued)

*Primary Examiner* — Lee D Wilson
(74) *Attorney, Agent, or Firm* — Sam Pierce

(57) ABSTRACT

An apparatus and method for installing a replacement grip onto a golf club shaft are disclosed. The apparatus comprises an elongated gripping tool body with a longitudinal slot, a resilient expandable gripping bushing, and a push plate. The method involves expanding the bushing, inserting the shaft, and applying force to install the grip while the push plate borders a stable surface. The second partially closed end of the tool body prevents the bushing from passing through during installation. The apparatus and method enable efficient and secure golf club grip replacement.

13 Claims, 8 Drawing Sheets

(56) References Cited

U.S. PATENT DOCUMENTS

| | | | | |
|---|---|---|---|---|
| 2013/0247670 | A1* | 9/2013 | Holtzman | G01M 7/027 73/579 |
| 2018/0304129 | A1* | 10/2018 | Hoss | A63B 57/60 |
| 2019/0224542 | A1* | 7/2019 | Hoss | F16B 7/02 |

* cited by examiner

INSTRUCTION SHEET

Thank you for acquiring the Gripping Tool. This tool eliminates the need for a stationary vise and makes it quick and easy to re-grip your golf clubs.

1. Your Gripping Tool consists of the two pieces below.

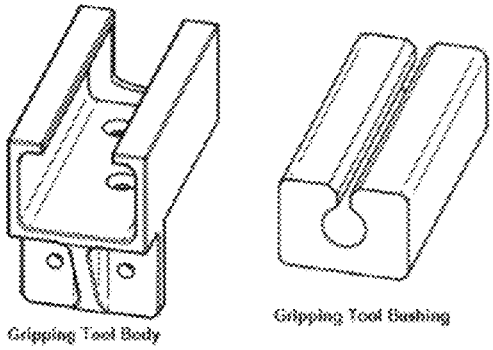

2. Attach the Gripping Bushing to the golf club shaft at the smallest circumference of the shaft near the club head.

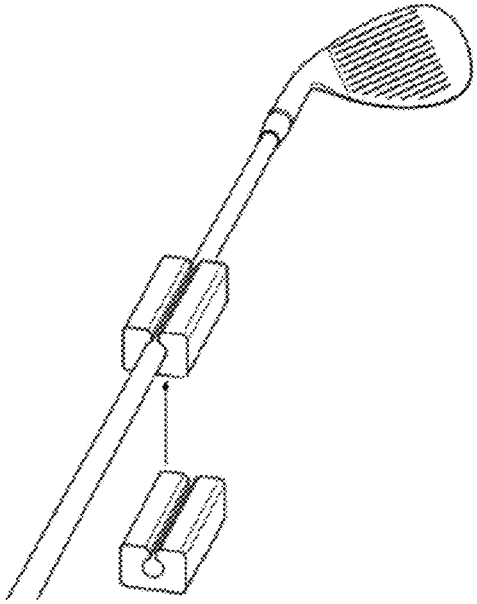

Note - This tool is designed to firmly hold your golf club as it is being re-gripped. Please follow the grip manufacturer's instruction for shaft preparation and installation of the replacement grips.

3. Once the Gripping Bushing is in place on the golf club shaft simply slide the Gripping Tool Body over the Gripping Bushing.

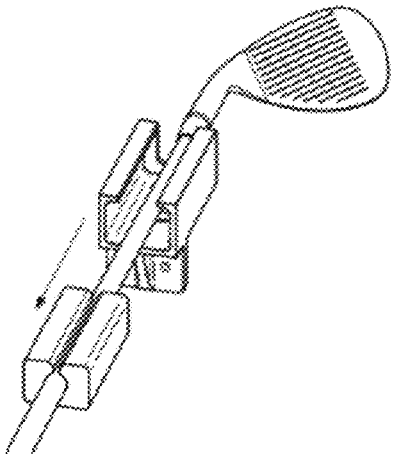

4. Once the Gripping Tool is affixed to the golf club shaft it can be placed against any stable non-moving surface and the replacement grips can be installed as per the grip manufacturer's instructions. As an example, the stable surface may be a work bench, countertop, a table placed against a wall, a stairway landing, a truck tailgate, or any other suitable surface. If you choose it is also possible to temporarily or permanently attach the Gripping Tool to a stable surface using the screw hole provided in the tool.

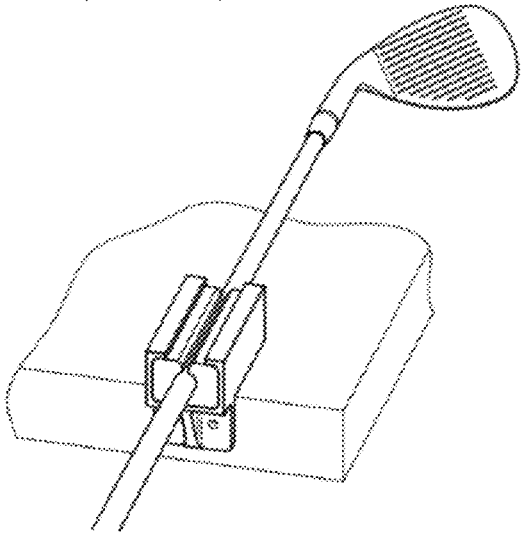

FIG. 8

GOLF CLUB GRIP INSTALLATION APPARATUS AND METHOD

BACKGROUND

The present invention relates generally to an apparatus and method for applying a grip to a golf club shaft. More specifically, the invention pertains to a tool that facilitates the installation and replacement of grips on golf club shafts without requiring a stationary vise or workshop.

Golf clubs typically consist of an elongated tapered shaft with a club head affixed to one end and a grip attached to the opposite end. The grip, usually made of rubber, synthetic materials, or a combination thereof, provides a comfortable and secure interface for the golfer to hold the club. However, with regular use, golf club grips wear out, become damaged, or lose their elasticity, necessitating replacement.

The conventional process of replacing golf club grips involves several steps, including cutting off the old grip, cleaning the shaft surface, applying double-sided tape or adhesive, and sliding the new grip over the prepared shaft. Importantly, grip manufacturers often recommend securing the golf club shaft in a stationary vise during installation to ensure proper alignment and a tight fit of the new grip.

While this process is common, it presents challenges for golfers who lack access to a workshop or stationary vise. Many grip replacement kits include protective pads designed to prevent damage to the shaft when clamped in a vise, underscoring the assumption that a vise is necessary for proper installation. As a result, golfers often resort to having grips replaced by professionals, which can be time-consuming and costly, especially for an entire set of clubs.

Various tools and methods have been proposed to address the challenges associated with golf club grip installation. For example, U.S. Pat. No. 5,407,026 discloses an apparatus that lubricates the interior surface of a grip and the exterior of a shaft to facilitate grip installation. Similarly, U.S. Pat. No. 6,308,761 describes a hand tool that holds a flexible member with a central opening, which can be used to apply adhesive or wrap tape around a golf club shaft. While these inventions provide alternatives to the traditional grip installation process, they do not eliminate the need for a vise or offer a comprehensive solution for easily replacing grips in any setting.

Considering the limitations of the prior art, there remains a need for an improved apparatus and method that enables golfers to efficiently and effectively install and replace golf club grips without relying on a stationary vise or professional assistance. The present invention addresses this need by providing a novel tool and method that simplifies the grip installation process and allows it to be performed in various environments.

SUMMARY

The present invention is directed to an apparatus and method for installing a grip onto a golf club shaft. In one embodiment, the apparatus includes a gripping tool body comprising an elongated tube with a first open end, a second partially closed end, and a longitudinal slot extending from the first open end. The second partially closed end has an aperture smaller than the internal cross-section of the elongated tube. A resilient gripping bushing is configured to be removably inserted into the first open end of the gripping tool body. The gripping bushing has a longitudinal slit extending along its length, enabling it to resiliently expand to receive a portion of the golf club shaft when urged through the longitudinal slit. The gripping tool body further includes a push plate extending from its outer surface, configured to border against a stable surface to prevent movement during grip installation.

In various embodiments, the elongated tube may be constructed from injection molded aluminum, while the resilient gripping bushing may be made of extruded natural rubber. The longitudinal slot of the gripping tool body can extend from the first open end to a point near the second partially closed end, and the aperture of the second partially closed end may have a diameter between 50-80% of the internal cross-section diameter of the elongated tube. The longitudinal slit of the gripping bushing can extend along its entire length, enabling it to expand between 5-20% to accommodate the golf club shaft portion.

The push plate may be integrally formed with and extend perpendicularly from the outer surface of the elongated tube, configured to border against various stable surfaces such as walls, workbenches, tables, stairways, or vehicle tailgates. The apparatus can further include a replacement golf club grip, with the push plate resisting the force applied during installation onto the shaft positioned within the gripping tool body and bushing. Graduation marks may be provided on the gripping tool body to indicate the insertion depth of the gripping bushing, and the external surface of the bushing can have a high friction material to resist rotation within the elongated tube during grip installation.

A method of installing a replacement grip onto a golf club shaft is also provided. The method includes providing a golf club grip installation tool with an elongated gripping tool body, expanding a cylindrical gripping bushing by applying force to its gap, inserting a portion of a golf club shaft into the bushing, inserting the bushing with the retained shaft into the gripping tool body, bordering the push plate against a stable surface, and applying force to install the replacement grip onto the shaft. The second semi-closed end prevents the bushing from passing completely through the tool body during installation. After installation, the bushing and shaft can be removed from the tool body, allowing for adjustment of the grip alignment on the shaft.

Additional features and advantages of the invention will be set forth in the description which follows, and in part will be obvious from the description, or may be learned by the practice of the invention. These and other features of the present invention will become more fully apparent from the following description, or may be learned by the practice of the invention as set forth hereinafter.

BRIEF DESCRIPTION OF THE DRAWINGS

The various exemplary embodiments of the present invention. which will become more apparent as the description proceeds, are described in the following detailed description in conjunction with the accompanying drawings, in which:

FIG. 8 is a depiction of the method of use.

Figure 1:
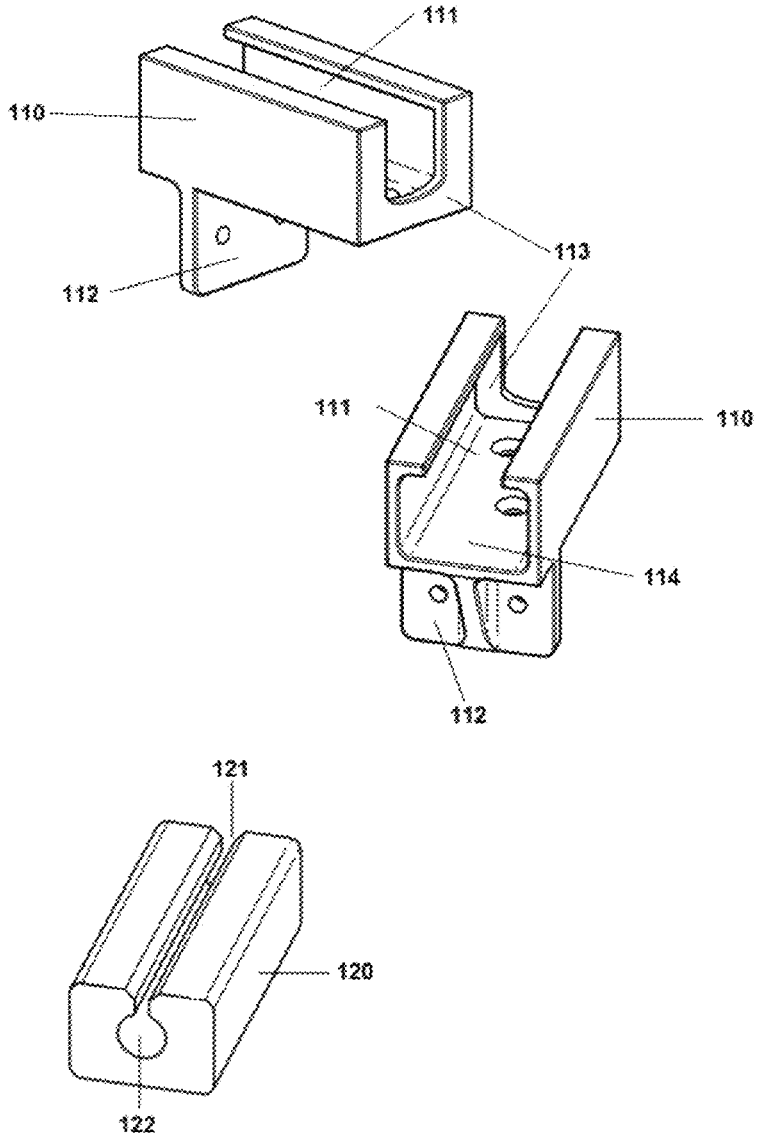
FIG. 1 illustrates an example of the two components that form the gripping tool.

In the following detailed description of the preferred embodiments, reference is made to the accompanying drawings, which form a part hereof and show, by way of illustration, specific embodiments in which the invention may be practiced. It is to be understood that other embodiments may be used and structural or logical changes may be made without departing from the scope of the present invention. The following detailed description, therefore, is not to be taken in a limiting sense, and the scope of the present invention is defined by the appended claims.

The following description is provided as an enabling teaching of the present systems, and/or methods in its best, currently known aspect. To this end, those skilled in the relevant art will recognize and appreciate that many changes can be made to the various aspects of the present systems described herein, while still obtaining the beneficial results of the present disclosure. It will also be apparent that some of the desired benefits of the present disclosure can be obtained by selecting some of the features of the present disclosure without utilizing other features.

Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

The terms "a" and "an" and "the" and similar references used in the context of describing a particular embodiment of the present invention (especially in the context of certain claims) are construed to cover both the singular and the plural. The recitation of ranges of values herein is merely intended to serve as a shorthand method of referring individually to each separate value falling within the range. Unless otherwise indicated herein. each individual value is incorporated into the specification as if it were individually recited herein.

All systems described herein can be performed in any suitable order unless otherwise indicated herein or otherwise clearly contradicted by context. The use of any and all examples, or exemplary language (for example, "such as") provided with respect to certain embodiments herein is intended merely to better illuminate the application and does not pose a limitation on the scope of the application otherwise claimed. No language in the specification should be construed as indicating any non-claimed element essential to the practice of the application. Thus, for example, reference to "an element" can include two or more such elements unless the context indicates otherwise.

As used herein, the terms "optional" or "optionally" mean that the subsequently described event or circumstance can or cannot occur, and that the description includes instances where said event or circumstance occurs and instances where it does not.

The word or as used herein means any one member of a particular list and also includes any combination of members of that list. Further, one should note that conditional language, such as, among others, "can," "could," "might." or "may." unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

FIG. 1 illustrates an apparatus for installing a replacement grip onto a golf club shaft, the apparatus comprising:

a gripping tool body 110 comprising an elongated tube having a first open end 114, a second partially closed end 113, and a longitudinal slot 111 extending from the first open end 114, wherein the second partially closed end 113 comprises an aperture smaller than an internal cross-section of the elongated tube; and a resilient gripping bushing 120 configured to be removably inserted into the first open end 114 of the gripping tool body 110, the gripping bushing 120 comprising a longitudinal slit 121 extending along a length of the gripping bushing 120, wherein the longitudinal slit 121 enables the gripping bushing 120 to resiliently expand to receive a portion of a golf club shaft 140 when the portion is urged through the longitudinal slit 121;

wherein the gripping tool body 110 further comprises a push plate 112 extending from an outer surface of the elongated tube, the push plate 112 configured to border against a stable surface to prevent movement of the gripping tool body 110 during installation of a grip 130 onto the golf club shaft 140.

The elongated tube of the gripping tool body 110 may be constructed from injection molded aluminum. The resilient gripping bushing 120 may be constructed from extruded natural rubber. The longitudinal slot 111 of the gripping tool body 110 extends from the first open end 114 to a point proximate the second partially closed end 113. The aperture of the second partially closed end 113 has a diameter between 50-80% of the internal cross-section diameter of the elongated tube. The push plate 112 is integrally formed with and extends perpendicularly from the outer surface of the elongated tube. The push plate 112 is configured to border against a vertical stable surface selected from the group consisting of: a wall, workbench, table, stairway, and vehicle tailgate. The elongated tube further comprises mounting holes configured to enable permanent attachment of the gripping tool body 110 to a stable surface.

Figure 2:
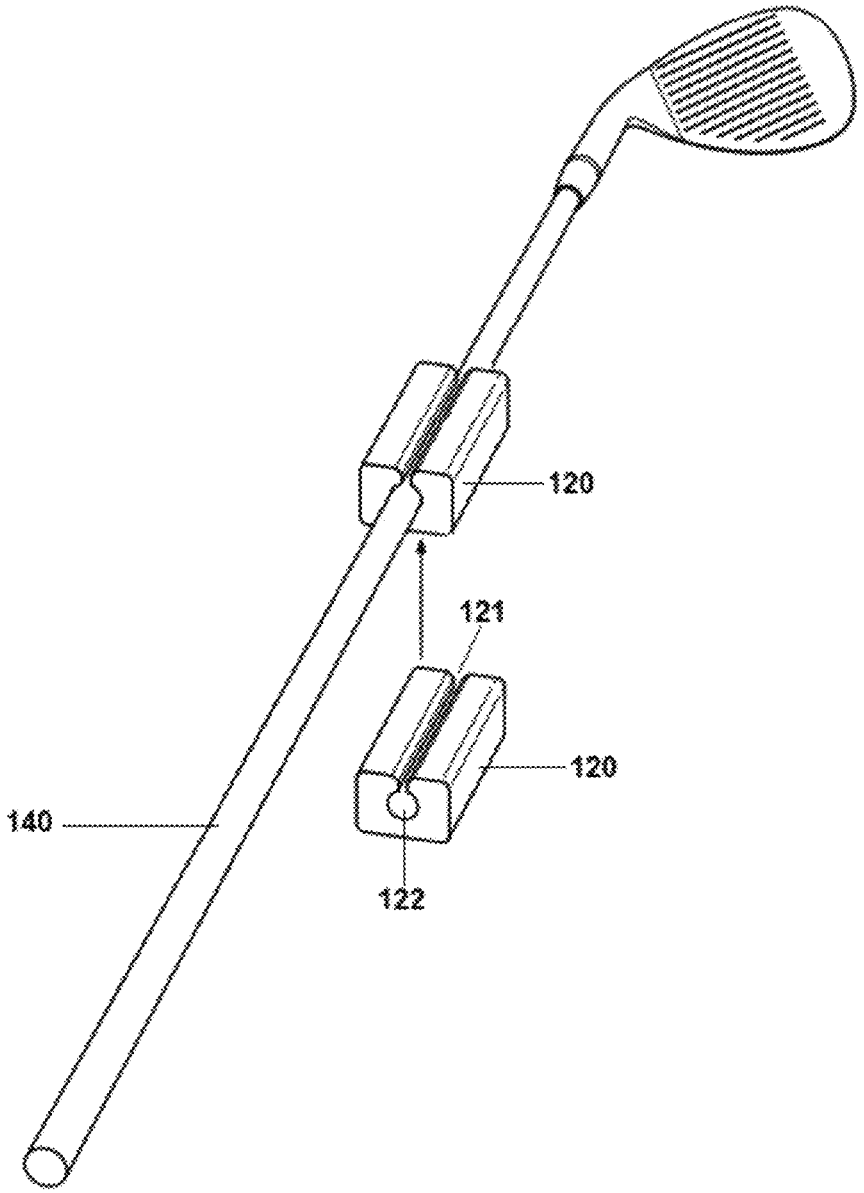
FIG. 2 illustrates an example of how the gripping bushing affixes onto a golf club shaft.

FIG. 2 shows the resilient gripping bushing 120 with the longitudinal slit 121 that extends along the entire length of the gripping bushing 120 from a first end to a second end. The longitudinal slit 121 enables the gripping bushing 120 to expand between 5-20% to accommodate receiving the portion of the golf club shaft 140. Placing the longitudinal slit 121 against the golf club shaft 140 at the smallest circumference portion near the golf club head and applying slight pressure allows the longitudinal slit 121 to widen enough to slip the gripping bushing 120 onto the golf club shaft 140 and seat the shaft into the re-gripping position 122 of the gripping bushing 120.

Figure 3:
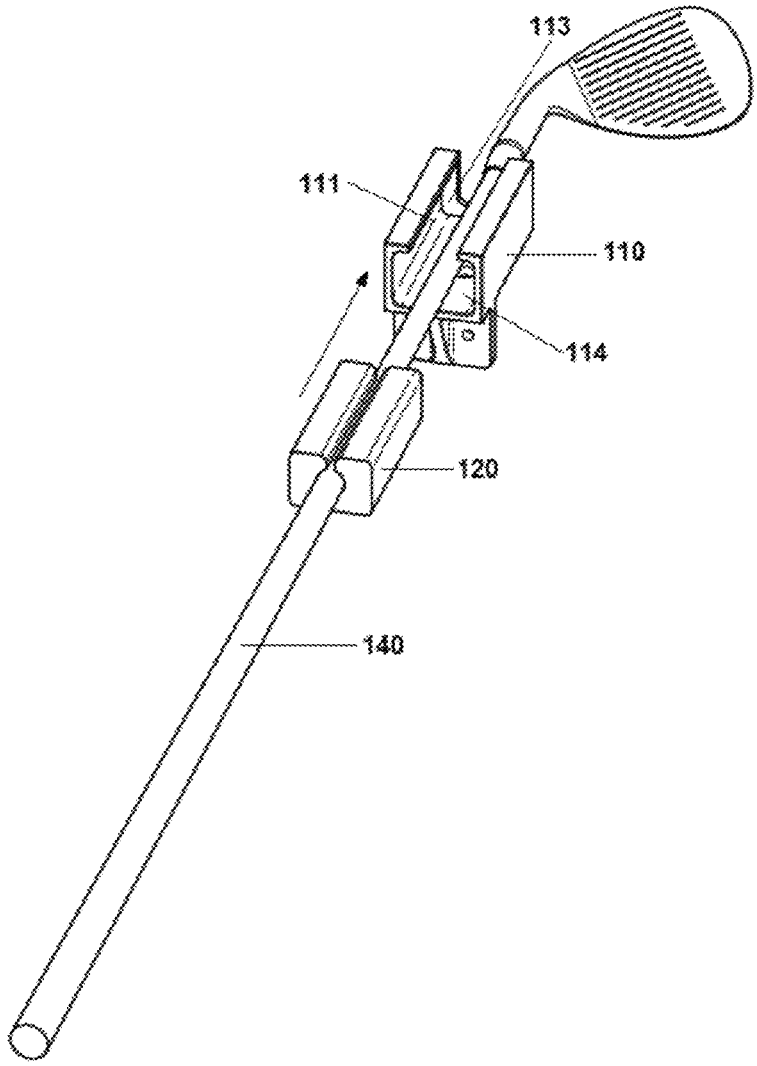
FIG. 3 illustrates the golf club shaft being placed into the golf shaft receiving slot of the gripping tool body and the gripping bushing sliding into the receiving slot of the gripping tool body.
Figure 4:
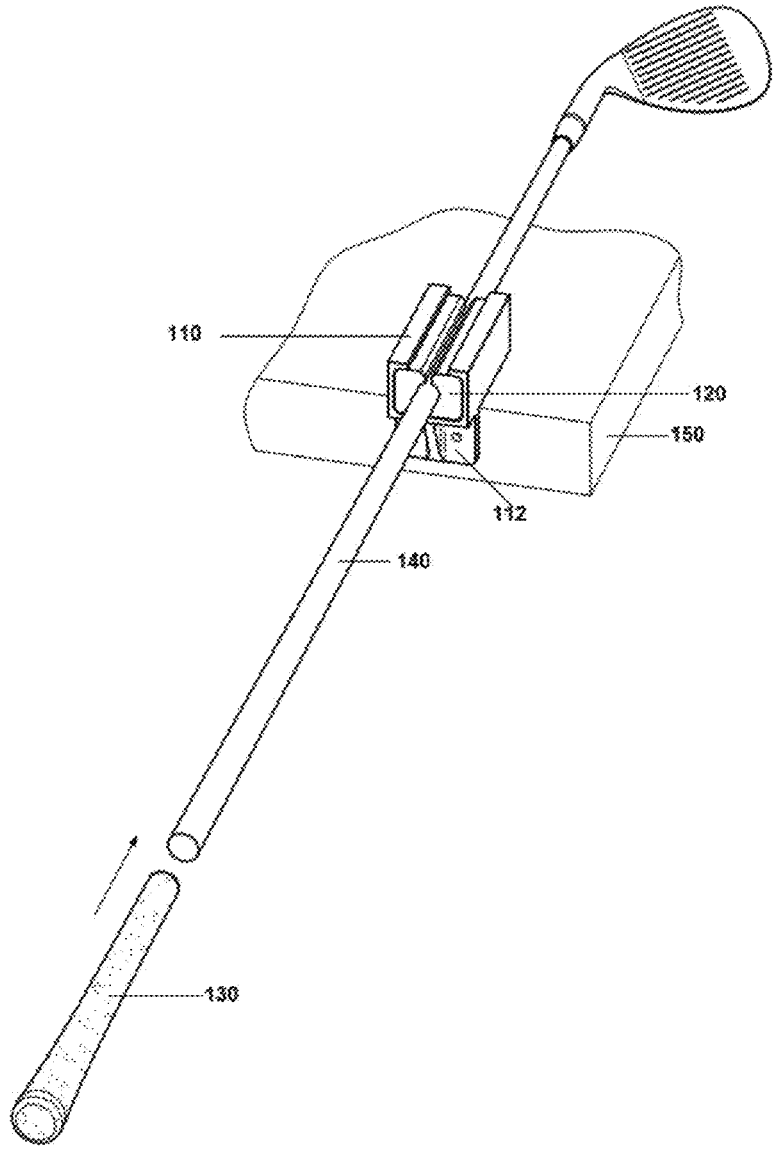
FIG. 4 illustrates the gripping tool body with the golf club and gripping bushing in the gripping position being placed against a solid surface and ready to receive the replacement grip.

FIG. 3 depicts a method of installing a replacement grip onto a golf club shaft, the method comprising:

providing the golf club grip installation tool comprising the elongated gripping tool body 110 having the first open end 114, the second semi-closed end 113, the golf club shaft receiving slot 111, and the push plate 112 extending from a bottom surface of the gripping tool body 110;

expanding the cylindrical gripping bushing 120 by applying force to the longitudinal slit 121 extending along the length of the gripping bushing 120;

inserting a portion of the golf club shaft 140 into a golf club shaft seating portion 122 disposed within the cylindrical gripping bushing 120;

inserting the cylindrical gripping bushing 120 with the golf club shaft 140 retained therein into the first open end 114 of the elongated gripping tool body 110, such that the golf club shaft 140 is received within the golf club shaft receiving slot 111;

bordering the push plate 112 against a stable surface as seen in FIG. 4; and applying a force to the replacement grip 130 to install the replacement grip 130 onto the golf club shaft 140, wherein the second semi-closed end 113 prevents the cylindrical gripping bushing 120 from passing completely through the elongated gripping tool body 110 during installation of the replacement grip 130 as seen in FIG. 4.

The resilient gripping bushing 120 is removable from the elongated tube after installing the replacement golf club grip 130. Removing the resilient gripping bushing 120 from the elongated tube enables adjusting an alignment of the replacement golf club grip 130 on the golf club shaft 140.

FIG. 4 illustrates the golf club grip installation tool 100 in use, with the golf club shaft 140 firmly seated within the gripping tool body 110. The push plate 112, which extends perpendicularly from the bottom surface of the gripping tool body 110, is placed against a non-movable stable surface 150. This stable surface 150 may be selected from a group consisting of a wall, workbench, table, stairway, or vehicle tailgate. With the tool 100 in this position, a replacement golf grip 130 can be affixed to the previously prepared golf club shaft 140. The push plate 112 resists the force applied to the replacement golf grip 130 during installation onto the golf club shaft 140 positioned within the gripping tool body 110 and gripping bushing 120.

Figure 5:
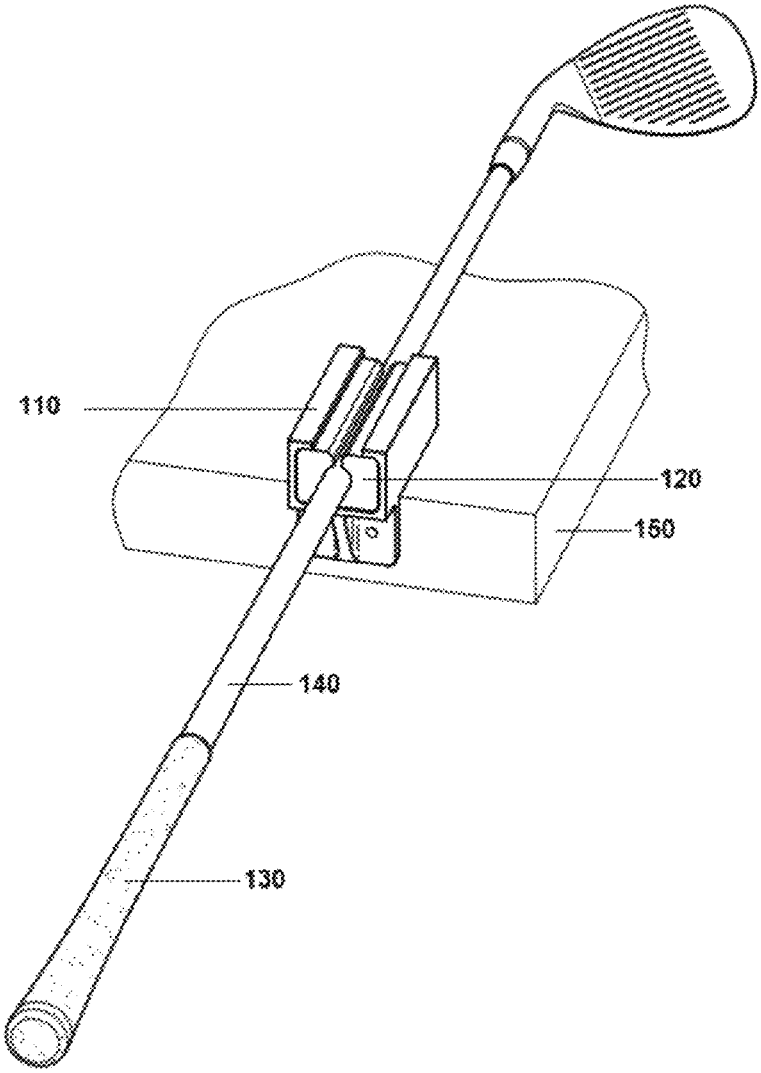
FIG. 5 illustrates the gripping tool body with the golf club and gripping bushing in the gripping position placed against a solid surface after the replacement grip has been installed.

FIG. 5 depicts the golf club grip installation tool 100 after the replacement grip 130 has been fully installed onto the golf club shaft 140. To install the replacement grip 130, pressure is applied to the replacement grip 130 in a direction towards the second semi-closed end 113 of the elongated gripping tool body 110. The resistance provided by the push plate 112 against the stable surface 150 and the gripping bushing 120 against the gripping bushing stop 113 (shown in FIG. 3) within the gripping tool body 110 allows the replacement grip 130 to be securely installed onto the previously prepared golf club shaft 140. Once the installation is complete, the golf club shaft 140 with the newly installed replacement grip 130 can be easily removed from the gripping tool body 110, and the gripping bushing 120 can be removed to allow for any necessary adjustments to the replacement grip 130 alignment.

Figure 6:
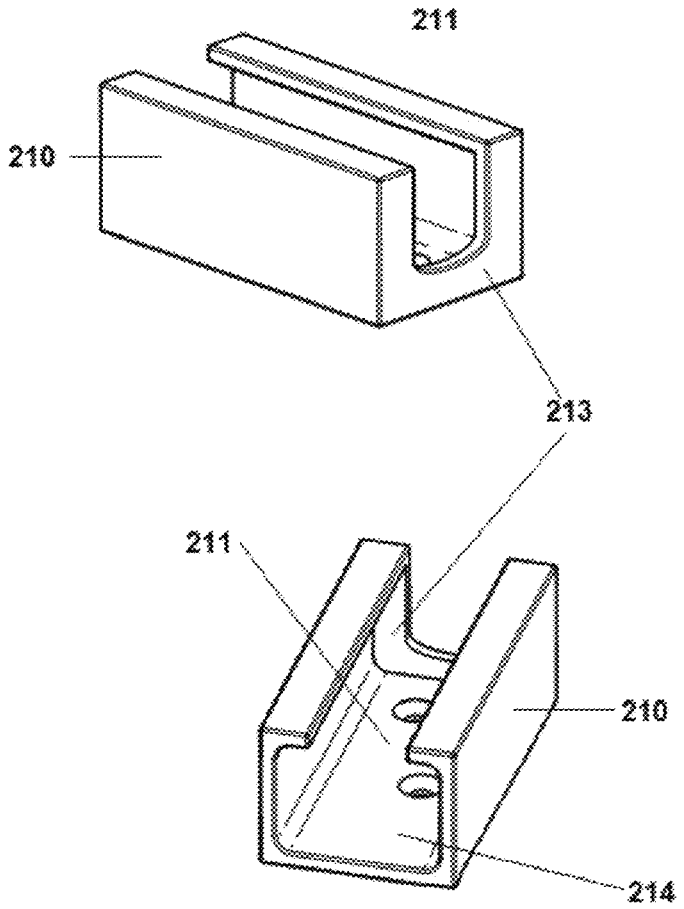
FIG. 6 illustrates example of a different version of the gripping tool body on which the push plate has been deleted and the unit has been designed to be permanently attached to a stable surface.

FIG. 6 illustrates an alternative embodiment of the gripping tool body 210, which is designed to be permanently attached to a stable surface. This version of the gripping tool body 210 does not include a push plate, but instead features mounting holes that enable permanent attachment to a stable surface. The elongated tube of the gripping tool body 210 in this embodiment is comprised of injection molded aluminum. This alternative design allows for a more stationary setup of the golf club grip installation tool, suitable for frequent use in a workshop or similar setting.

Figure 7:
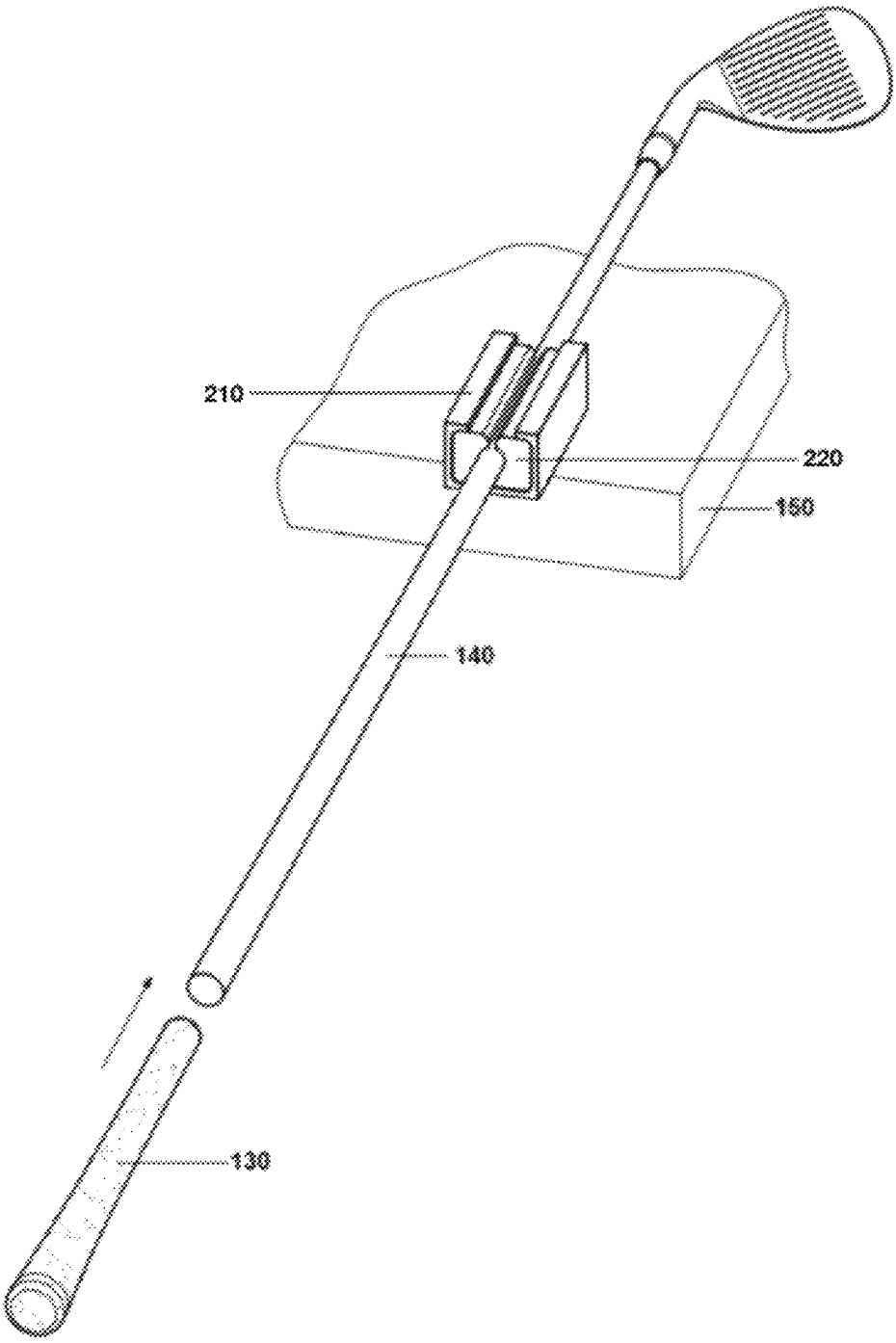
FIG. 7 illustrates the golf club shaft being placed into the receiving slot of the permanently attached gripping tool body and gripping bushing sliding into the receiving slot of the gripping tool body.

FIG. 7 illustrates a step in the method of installing a replacement grip 130 onto a golf club shaft 140 using the golf club grip installation tool 100. The golf club shaft 140 is shown being inserted into the golf club shaft receiving slot 111 of the elongated gripping tool body 210. The gripping tool body 210 is an alternative embodiment to the gripping tool body 110 shown in previous figures, with the key difference being that the gripping bushing 120 is permanently attached within the gripping tool body 210. As the golf club shaft 140 is inserted, the cylindrical gripping bushing 120 slides into the golf club shaft receiving slot 111 of the gripping tool body 210. The gripping bushing stop 113 at the second semi-closed end of the gripping tool body 210 prevents the gripping bushing 120 from passing completely through during use. This figure provides support for the method steps recited in claims 15 and 23, showing the insertion of the shaft 140 into the slot 111 of the permanently attached version of the tool body 210.

FIG. 8 provides an overview of the method steps for using the golf club grip installation tool 100 to install a replacement grip 130 onto a golf club shaft 140. The method includes expanding the cylindrical gripping bushing 120 by applying force to the gap or longitudinal slit 121 extending along its length, inserting a portion of the golf club shaft 140 into the golf club shaft seating portion 122 within the expanded gripping bushing 120, and then inserting the bushing 120 with the shaft 140 into the first open end 114 of the elongated gripping tool body 110 so the shaft 140 is received in the longitudinal slot 111.

The push plate 112 extending from the bottom of the tool body 110 is abutted against a stable surface 150, which may be a work bench, countertop, table against a wall, stairway landing, or truck tailgate. Force is then applied to the replacement grip 130 to push it onto the shaft 140 towards the second semi-closed end of the tool body 110. The gripping bushing stop 113 prevents the bushing 120 from passing through completely.

After installation, the bushing 120 and shaft 140 can be removed from the tool body 110, and the bushing 120 removed from the shaft (140) to allow adjustment of the grip 130 alignment on the shaft 140 if needed. The external surface of the gripping bushing 120 is made of a high friction material to resist rotation in the tool body 110 during grip installation.

The tool body 110 also includes graduation marks near the first open end 114 to indicate the insertion depth of the gripping bushing 120.

The embodiments described herein are given for the purpose of facilitating the understanding of the present invention and are not intended to limit the interpretation of the present invention. The respective elements and their arrangements, materials, conditions, shapes, sizes, or the like of the embodiment are not limited to the illustrated examples but may be appropriately changed. Further, the constituents described in the embodiment may be partially replaced or combined together.

What is claimed is:

1. An apparatus for installing a grip onto a golf club shaft, the apparatus comprising:

a gripping tool body comprising a rectangular channel having a first open end, a second partially closed end, and a longitudinal slot extending from the first open end, wherein the second partially closed end comprises an aperture smaller than an internal cross-section of the rectangular channel; and a resilient gripping bushing configured to be removably inserted into the first open end of the gripping tool body, the gripping bushing comprising a longitudinal slit extending along a length of the gripping bushing, wherein the longitudinal slit enables the gripping bushing to resiliently expand to receive a portion of the golf club shaft when the portion is urged through the longitudinal slit;

wherein the gripping tool body further comprises a push plate extending from an outer surface of the elongated tube, the push plate configured to border against a stable surface to prevent movement of the gripping tool body during installation of the grip onto the golf club shaft;

wherein the push plate is integrally formed with and extends perpendicularly from the bottom surface of the elongated gripping tool body;

wherein the push plate is positioned on the bottom surface between the first open end and the second partially closed end; and wherein the push plate is configured to push against a stable surface to allow the gripping bushing to firmly abut against the second partially closed end.

2. The apparatus of claim 1, wherein the rectangular channel of the gripping tool body is constructed from injection molded aluminum.

3. The apparatus of claim 1, wherein the resilient gripping bushing is constructed from extruded natural rubber.

4. The apparatus of claim 1, wherein the longitudinal slot of the gripping tool body extends from the first open end to a point proximate the second partially closed end.

5. The apparatus of claim 1, wherein the aperture of the second partially closed end has a diameter between 50-80% of the internal cross-section diameter of the elongated tube.

6. The apparatus of claim 1, wherein the longitudinal slit of the gripping bushing extends along the entire length of the gripping bushing from a first end to a second end.

7. The apparatus of claim 6, wherein the longitudinal slit enables the gripping bushing to expand between 5-20% to accommodate receiving the portion of the golf club shaft.

8. The apparatus of claim 1, wherein the push plate is configured to border against a vertical stable surface selected from the group consisting of: a wall, workbench, table, stairway, and vehicle tailgate.

9. The apparatus of claim 1, further comprising a replacement golf club grip configured to be installed onto the golf club shaft, wherein the push plate resists a force applied to the replacement golf club grip during installation onto the golf club shaft positioned within the gripping tool body and gripping bushing.

10. The apparatus of claim 1, wherein the gripping tool body further comprises graduation marks proximate the first open end to indicate an insertion depth of the gripping bushing into the elongated tube.

11. The apparatus of claim 1, wherein an external surface of the gripping bushing comprises a high friction material to resist rotation of the gripping bushing within the rectangular channel during the installation of the grip onto the golf club shaft.

12. The apparatus of claim 1, wherein the rectangular channel further comprises mounting holes configured to enable permanent attachment of the gripping tool body to a stable surface.

13. The apparatus of claim 1, further comprising:

wherein the resilient gripping bushing is removable from the elongated tube after installing the replacement golf club grip; and wherein removing the resilient gripping bushing from the rectangular channel enables adjusting an alignment of the replacement golf club grip on the golf club shaft.

* * * * *